US009097086B2

(12) United States Patent
AlDossary

(10) Patent No.: US 9,097,086 B2
(45) Date of Patent: Aug. 4, 2015

(54) WELL TRACTOR WITH ACTIVE TRACTION CONTROL

(75) Inventor: Khalid Abdullah AlDossary, Damman (SA)

(73) Assignee: Saudi Arabian Oil Company, Dhahran (SA)

( * ) Notice: Subject to any disclaimer, the term of this patent is extended or adjusted under 35 U.S.C. 154(b) by 788 days.

(21) Appl. No.: 13/236,101

(22) Filed: Sep. 19, 2011

(65) Prior Publication Data

US 2013/0068479 A1 Mar. 21, 2013

(51) Int. Cl.

| | |
|---|---|
| ***E21B 23/14*** | (2006.01) |
| ***E21B 4/18*** | (2006.01) |
| *E21B 23/00* | (2006.01) |

(52) U.S. Cl.

CPC . *E21B 23/14* (2013.01); *E21B 4/18* (2013.01); *E21B 2023/008* (2013.01)

(58) Field of Classification Search

CPC ..... E21B 23/14
USPC ..... 166/66.5; 175/51, 97, 99
See application file for complete search history.

(56) References Cited

U.S. PATENT DOCUMENTS

| | | | |
|---|---|---|---|
| 6,257,356 | B1 | 7/2001 | Wassell |
| 6,273,189 | B1 | 8/2001 | Gissler et al. |
| 6,910,533 | B2 | 6/2005 | Guerrero |
| 6,920,936 | B2 | 7/2005 | Sheiretov et al. |
| 7,036,612 | B1 | 5/2006 | Raymond et al. |
| 7,219,752 | B2 | 5/2007 | Wassell et al. |
| 7,516,782 | B2 | 4/2009 | Sheiretov et al. |
| 2003/0192687 | A1 | 10/2003 | Goodson, Jr. et al. |
| 2005/0007059 | A1 | 1/2005 | Chew et al. |
| 2005/0217867 | A1 | 10/2005 | Misselbrook |
| 2007/0012452 | A1 | 1/2007 | Le Cunff et al. |
| 2007/0181298 | A1 | 8/2007 | Sheiretov et al. |
| 2008/0047715 | A1 | 2/2008 | Moore |
| 2008/0066963 | A1 | 3/2008 | Sheiretov et al. |
| 2010/0187009 | A1 | 7/2010 | Siher et al. |
| 2010/0224360 | A1 | 9/2010 | MacDougall et al. |
| 2011/0127046 | A1 | 6/2011 | Aguirre et al. |

FOREIGN PATENT DOCUMENTS

| | | | |
|---|---|---|---|
| WO | 2005008023 | A1 | 1/2005 |
| WO | 2005047640 | A2 | 5/2005 |

OTHER PUBLICATIONS

Hallundbaek, Jorgen; Ostvang, Knut; Haukvik, John; and Skeie, Terje; "Wireline Well Tractor: Case Histories"; Offshore Technology Conference OTC 8535; May 5-8, 1997; pp. 395-398; Offshore Technology Conference, Houston, Texas US (4 pages).

(Continued)

*Primary Examiner* — William P Neuder
*Assistant Examiner* — Richard Alker
(74) *Attorney, Agent, or Firm* — Bracewell & Giuliani LLP; Constance Gall Rhebergen; Keith R. Derrington

(57) ABSTRACT

A downhole tool that includes a tractor for assisting movement of the tool through deviated portions of a wellbore. The tractor includes a working fluid that damps vibrations in the tractor by adjusting the viscosity in the fluid. In an example, the working fluid is a magnetorheological fluid that has a viscosity that changes in response to applied electrical energy. The working fluid, which may be used for powering actuators on the tractor, may contain a suspension of magnetic particles.

20 Claims, 5 Drawing Sheets

(56) References Cited

OTHER PUBLICATIONS

Whiteley, D.; Pourciau, R.; and Schwanitz, B.; "Case History: Designing and Implementing Wireline Tractoring Applications for Deepwater, Extended-Reach, Sand-Control Completions and Interventions"; SPE 96093; Oct. 9-12, 2005; pp. 1-6; SPE International, 2005 Annual Technical Conference and Exhibition, Dallas, Texas US (6 pages).

Al-Dhufairi, Mubarak; Al-Ghamdi, Abdulrahman; Lewis, David; and Nafa, Hamed; "Pushing The Wireline Operation to New Frontiers"; SPE 113655; Apr. 1-2, 2008; pp. 1-8; SPE International, Society of Petroleum Engineers, 2008 SPE/ICoTA Coiled Tubing and Well Intervention Conference and Exhibition, The Woodlands, Texas US (8 pages).

Shiong, Lam Fei; Collins, Joseph Paul; and Schwanitz, Brian; "Wireline Tractor Technology Supports Fast Tracking New Well Design"; IADC/SPE 115202; Aug. 25-27, 2008; pp. 1-7; IADC/SPE Asia Pacific Drilling Technology Conference and Exhibition, Jakarta, Indonesia (7 pages).

Hashem, Mohamed K.; Al-Dossari, Saleh M.; Seifert, Douglas; Hassaan, Mohamed; and Foubert, Benoit; "An Innovative Tractor Design for Logging Openhole Soft Formation Horizontal Wells"; SPE 111347; Mar. 12-14, 2008; pp. 1-9; 2008 SPE North Africa Technical Conference and Exhibition, Marrakech, Morocco (9 pages).

Al-Amer, A.A.; Al-Dossary, B.A.; Al-Furaidan, Y.A.; and Hashem, M.K.; "Tractoring—A New Era in Horizontal Logging for Ghawar Field, Saudi Arabia"; SPE 93260; Mar. 12-15, 2005; pp. 1-5; 14th SPE Middle East Oil & Gas Show and Conference, Bahrain International Exhibition Centre, Bahrain, Saudi Arabia (5 pages).

Hashem, M.K.; Al-Dossari, S.M.; Marhaba, A.R.; and Zeybek, M.; "Evaluation of Wireline Tractor Performance in Various Well Completions in Saudi Arabia"; IPTC 10186; Nov. 21-23, 2005; pp. 1-8; International Petroleum Technology Conference, Doha, Qatar (8 pages).

Schlumberger; "TuffTRAC: Cased Hole Services Tractor"; 2009; pp. 1-4; www.slb.com/tufftrac; Schlumberger (4 pages).

PCT Notification of Transmittal of the International Search Report and the Written Opinion of the International Searching Authority, or the Declaration; dated Jun. 5, 2013; International Application No.: PCT/US2012/055754; International File Date: Sep. 17, 2012.

WELL TRACTOR WITH ACTIVE TRACTION CONTROL

BACKGROUND OF THE INVENTION

1. Field of the Invention

The present invention relates to a device for use in downhole operations. More specifically, the invention relates to adjusting the viscosity of a working fluid in a wellbore tractor to control vibration in the wellbore tractor.

2. Description of the Related Art

Coiled tubing and wire line may be used for deploying various downhole assemblies within a wellbore for performing various wellbore operations. The operations may be performed open hole before the well has been cased or lined, or after the well has been completed and having casing cemented within the wellbore. Example operations include setting or unsetting a tool within the wellbore, interrogating wellbore conditions such as by acoustics or resonance imaging, perforating within a wellbore, and the like. Increasingly, wellbores are drilled having lateral or deviated portions that are oriented oblique to a vertical axis of a primary wellbore. Wireline cannot be used for deploying tools in highly deviated wells, and coiled tubing is limited in its ability to urge the tools along these deviated portions. Moreover, coiled tubing can buckle and lockup to prevent movement of the tractor. Thus, tractor assemblies may be employed with the downhole tool for moving the tool through the deviated or lateral wellbore portions.

Typically, the tractors include a gripper portion that is selectively extended away from the downhole tool and into contact with an inner wall of the wellbore for pushing against the wall of the wellbore. The pushing by the gripper in turn motivates the downhole tool through the deviated or lateral section. Example grippers include wheels or rollers on the end of a gripper arm, or linkage assemblies that pivot out and push the tool along in an inchworm fashion. The tractor assemblies are often powered by a hydraulic system that is selectively pressurized for activating the grippers of the tractor assemblies.

Effectiveness of the tractor assemblies can be hampered by inconsistencies in the wellbore wall, either through changes in type of casing or, in an open hole condition, areas where the compressive strength of the formation varies. Washout sections in a wellbore can also introduce performance obstacles for wellbore tractors. To accommodate these inconsistencies, the tractor assembly must respond by altering the amount of extension away from the tool and/or the force supplied to a gripper arm and against a wellbore wall. The variations in applied force can introduce vibrations into the tractor assembly and the downhole tool that can be problematic for the movement of the downhole tool through the wellbore.

SUMMARY OF THE INVENTION

Disclosed herein is a tractor assembly for use with a downhole tool. An example embodiment of the tractor assembly includes an actuator selectively moveable between a deployed position and a stowed position. A gripper is included with the tractor assembly that is coupled to the actuator and selectively moveable between retracted and extended position. When in a retracted position the gripper is substantially contained within a body of the downhole tool and when in an extended position, the gripper in contact with a wellbore wall. Fluid is included with the tractor assembly that is in communication with the actuator for moving the actuator between the deployed and stowed positions.

Included within the fluid are magnetically responsive particles, so that a viscosity of the fluid increases when a magnetic field is applied to the fluid and dampens vibration in the tractor assembly. In an example embodiment, the tractor assembly includes a winding proximate a portion of the fluid and in communication with a source of electricity for generating the magnetic field that is applied to the fluid. In an example embodiment, the tractor assembly may have a controller in communication with the source of electricity for regulating the amount of vibration damping by the fluid by adjusting a magnitude of the magnetic field. In an example embodiment, the tractor assembly includes a sensor for detecting tractor assembly operating conditions in a wellbore and communicating the operating conditions to the controller. In an example embodiment, the tractor assembly operating conditions include a frictional force between the gripper and wellbore wall and wherein the controller adjusts the magnitude of the magnetic field in response to the sensed frictional force. In an example embodiment, the gripper can be a roller, a track assembly, or a linkage arm. In an example embodiment, the fluid contains carrier oil and the particles range in size from about 0.1 microns to about 10 microns.

Also disclosed herein is a downhole tool disposable in a wellbore. In an example embodiment, the downhole tool includes a body, a hydraulic actuation system in the body made up of a linkage actuator powered by a magnetorheological fluid selectively pressurized by a pressure source. The downhole tool also includes a gripper assembly mounted to the body and coupled to the hydraulic actuation system. The gripper assembly is selectively moveable between a stowed position substantially in the body and a deployed position in contact with a wall of the wellbore in response to movement of the hydraulic actuation system and selective pressurization of the fluid by the pressure source. A selectively activatable magnetic field source is included with the downhole tool, so that when the magnetic field is activated a magnetic field forms in the magnetorheological fluid, thereby altering a viscosity of the magnetorheological fluid and damping vibration in the hydraulic actuation system and the gripper assembly. In an example embodiment, the gripper assembly can be a roller, a track assembly, or a linkage arm.

Also disclosed herein is a method of pulling a downhole assembly through a wellbore. In an example embodiment, the method includes providing with the downhole assembly an actuator selectively moveable between a deployed position and a stowed position and a gripper coupled to the actuator. The gripper is selectively moveable between a retracted position substantially within a body of the downhole tool and to an extended position in contact with a wall of the wellbore. Also included with the downhole assembly is magnetorheological fluid in communication with the actuator for moving the actuator between the deployed and stowed positions. The method also includes deploying the downhole assembly in the wellbore and pressurizing the magnetorheological fluid. Pressurizing the fluid moves the actuator into the deployed position to extend the gripper into contact with the wellbore wall. Moving the gripper across the wellbore wall moves the downhole assembly within the wellbore. By sensing operating conditions of the downhole assembly, the magnetorheological fluid is selectively energized to adjust viscosity of the magnetorheological fluid. In an example embodiment, the operating conditions include parameters that include compressive strength of the wellbore wall, a profile of the wellbore wall, and a frictional force between the gripper and the wellbore wall. In an example embodiment, adjusting viscosity of the magnetorheological fluid damps vibration in the downhole assembly. In an example embodiment, sensing operating conditions of the downhole assembly involves monitoring a frictional force between the gripper and the wellbore wall, so selectively energizing the magnetorheological fluid adjusts the viscosity of the magnetorheological fluid so the frictional force between the gripper and the wellbore wall is at a value to prevent slippage between the gripper and the wellbore wall. In an example embodiment, the frictional force between the gripper and the wellbore wall is at a minimum value to prevent slippage between the gripper and the wellbore wall. In an example embodiment, a controller is used to determine an amount of electricity for energizing the magnetorheological fluid. In an example embodiment, energizing the magnetorheological fluid includes flowing electricity through a winding proximate a portion of the magnetorheological fluid.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
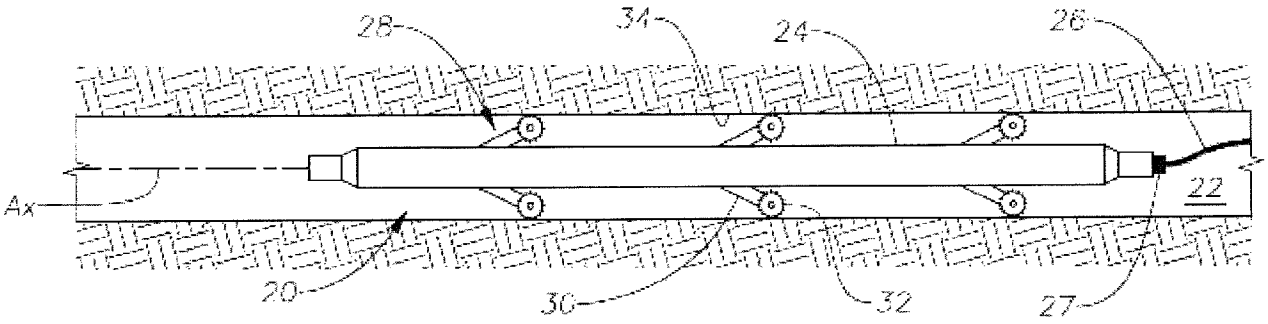
FIG. 1 is a side partial sectional view of an example embodiment of a downhole tool disposed in a wellbore having a tractor portion and in accordance with the present invention.

Shown in a side sectional view in FIG. 1 is an example embodiment of a downhole tool 20 disposed within a lateral portion of a wellbore 22. In the example of FIG. 1, the downhole tool 20 has a substantially elongate body 24 that is deployed on an end of a line 26 shown connected to one end of the body 24. In the example of FIG. 1, the line 26 can be one of a wireline, a slick line, or coiled tubing. A swivel valve 27 is optionally provided where the line 26 connects to the body 24 that allows the body 24 to rotate within the wellbore 22 without adding torque to the line 26. Example sources for powering the downhole tool 20 include onboard motors (not shown) that operate by battery, pressure, or hydraulically. In an alternate embodiment, the outer circumference of the body 24 can be oval shaped, which can force the tool 20 to tract against the low side of the wellbore 22 thereby balancing the weight and center of gravity of the tool 20. Included with the downhole tool 20 are tractor assemblies 28 for moving the tool 20 within the wellbore 22. The embodiments of the tractor assembly 28 in FIG. 1 are shown including an arm 30 mounted to the body 28 at an oblique angle to an axis $A_X$ of the wellbore 22 and a roller 32 on an end of the arm opposite the connection between the arm 30 and body 24. Thus, applying a rotational force onto the roller 32 in a designated direction can motivate the downhole tool 20 along within the wellbore 22. The tractor assemblies 28 can be axially aligned along the length of the downhole tool, 20 or can optionally be phased azimuthally around the body 24. The rollers 32 can be of different size and configuration, depending on a particular application, and resistant to corrosive materials.

In an example embodiment, a flow passage (not shown) is provided axially through the downhole tool 20 for passage of treatment fluids, such as water, diesel, $N_2$, etc. that may be flowing within the wellbore 22 during use of the downhole tool 20. A bypass valve (not shown) may be provided in instances when flowing fluids, such as acid, that can corrode components within the downhole tool 20.

Figure 2A:
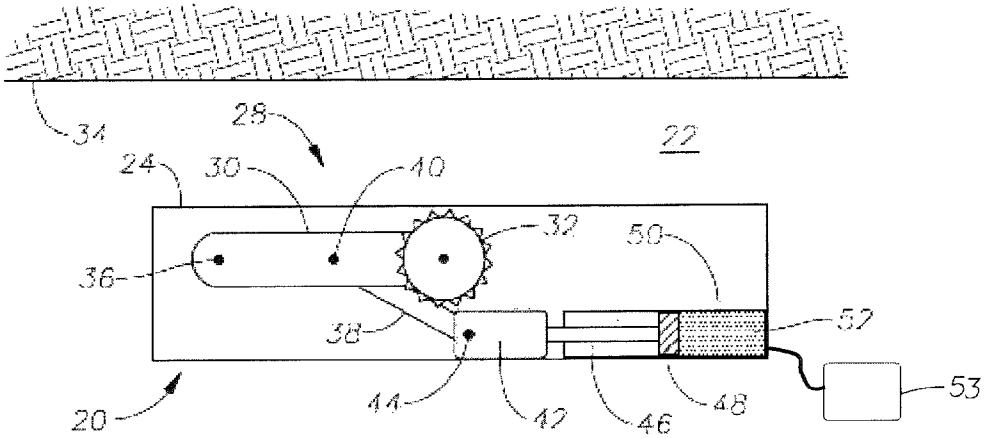
FIG. 2A is a side partial sectional view of an example embodiment of a gripper portion of the tractor portion of FIG. 1 in a retracted configuration.

Referring now to FIG. 2A, a tractor assembly 28 is shown provided within the body 24 of the downhole tool 20. In this configuration, the tractor assembly 28 is in a retracted position and substantially within the confines of the body 24. The arm 30 is oriented generally parallel with a length of the body 24, thereby disposing the arm 30 and attached roller 32 substantially within the body 24. Stowing the arm 30 and roller 32 as shown avoids contact with the wall of the wellbore 22 as the downhole tool 20 is lowered on the line 26. The arm 30 of FIG. 2A is shown mounted within the body 24 and pivotally attached by a pin 36; also attached to the arm 30 is a linkage rod 38 shown pivotingly mounted onto the arm between the pin 36 and roller 32 by a pin 40. Example embodiments exist having a single linkage rod 38 for each roller 32, or more than one linkage rod 38 per roller 32. The embodiment of the linkage rod 38 of FIG. 2A is an elongate member with its elongate length oriented along a line that is oblique to the elongate length of the arm 30. On an end of the linkage rod 38 opposite its attachment to the arm 30, the linkage rod 38 is attached to a trolley 42 by a pin 44. The pin 44 allows pivoting or orbiting motion of the linkage rod 38 with respect to the trolley 42. The embodiment of the trolley 42 of FIG. 2A is a generally rectangular member with an elongate length aligned substantially with that of the arm 30. A piston rod 46 is attached to the trolley 42 on an end distal from attachment of the linkage rod 38. The piston rod 46 depends from a piston 48 shown set within a cylinder 50. The cylinder 50, piston rod 46, and trolley 42 are shown each having generally aligned elongate lengths. A fluid 52 is illustrated housed within the cylinder 50 and on a side of the piston 48 opposite the attachment of the piston 48 to the piston rod 46. A pressure source 53 is shown that selectively pressurizes the fluid.

Figure 2B:
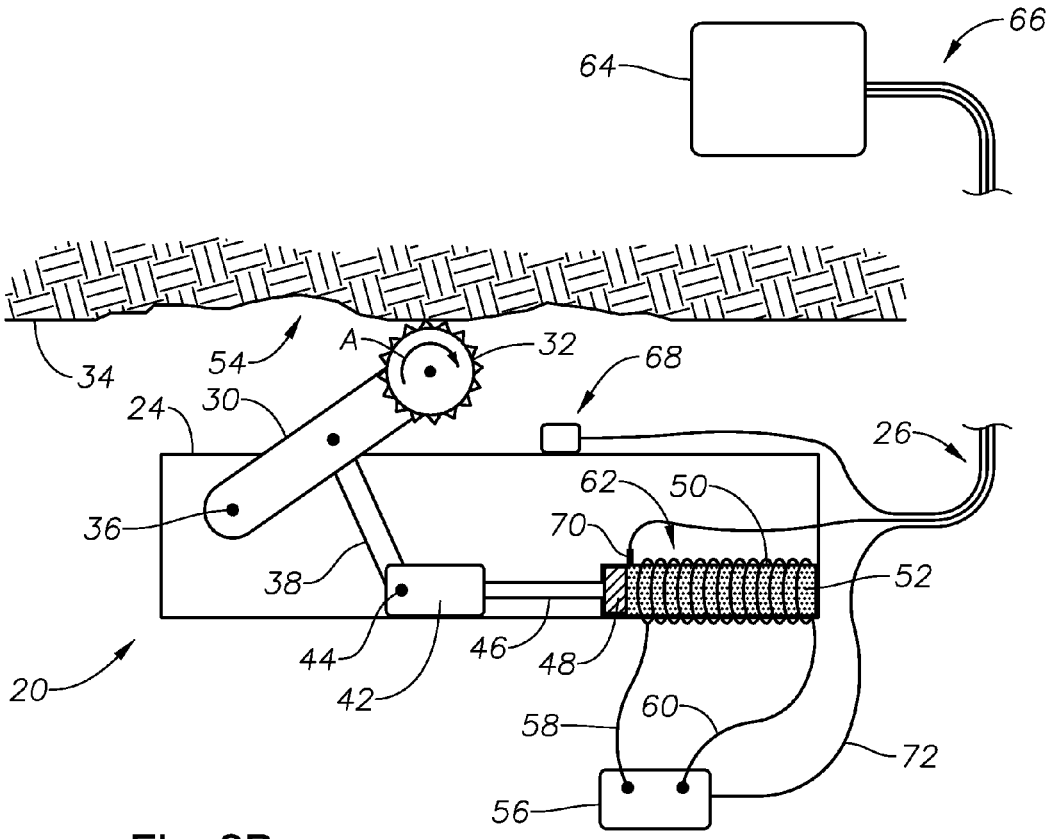
FIG. 2B is a side partial sectional view of an example embodiment of a gripper portion of the tractor portion of FIG. 1 in a deployed configuration.

Referring now to FIG. 2B, a side partial sectional view of the tractor assembly 28 of FIG. 2A is shown in a deployed or extended configuration with the arm 30 and roller 32 pivoted out from within the body 24. Deployment of the arm 30 and roller 32 is initiated by having the fluid 52 urge against the piston 48 as shown, thereby moving the piston 48, attached piston rod 46, and a trolley 42 in a direction away from the cylinder 50. In turn, the end of the linkage rod 38 attached to the trolley 42 is moved in a lateral direction, also away from the cylinder 50. The linkage rod 38 swings about its mid portion thereby urging the end of the arm 30 having the roller 32 outward and away from the body 24. The progression of movement of the linkage rod 38 is dictated by its pivoting connection with the trolley 42 via pin 44, and its pivoting connection with the arm 30 via pin 40. As shown, the roller 32 is urged into frictional contact with the wellbore wall 34 and thus by rotating the roller 32 in the direction of the arrow A, a translational force is imparted on the downhole tool 20 for motivating the tool 20 within the wellbore 22. As noted above, the wellbore wall 34 may include undulations 54 such as from washouts or other discontinuities thereby requiring further outward movement of the roller 32 to maintain frictional contact with the wellbore wall 34. Additionally, portions of the wellbore wall 34 may have a reduced compressive strength thereby allowing slippage between the roller 32 and the wellbore wall 34. Compensating for the undulations 54 and slippage may introduce vibratory waves within the tool 20 that can negatively affect the ability of the tractor assembly 28 to maintain sufficient frictional contact with the wellbore wall 34. It should be pointed out that the arm 30 can extend up to and pass 90° from the axis $A_X$ of the downhole tool 20, which may be necessary when the diameter of the wellbore 22 increases or when in a wellbore of larger diameter.

To address the issues of changing conditions in the wellbore 22, the fluid 52 may comprise magnetic particles. Thus in an example embodiment, subjecting the fluid 52 having the magnetic particles to a magnetic field can alter the viscosity of the fluid 52. As such, an optional energy source 56 is schematically shown having attached leads 58, 60 that connect on their opposite ends through a winding 62 shown circumscribing the cylinder 50. In an example embodiment, by selectively activating the energy source 56 the viscosity of the fluid 52 can be adjusted to a designated level. In one example of use, the viscosity of the fluid 52 can be regulated to maintain a designated or desired damping coefficient within the downhole tool 20, even as the tractor assembly 28 encounters changing operating conditions due to variations in the wellbore 20. Optionally, the energy source 56 can be a battery that may further optionally be disposed in or with the downhole tool 20. Downhole power generators may also make up the energy source 56. Alternatively, the energy source 56 can be disposed on surface.

An optional controller 64 may be included that communicates downhole via leads 66 that are included with the line 26 for direct communication to components on the downhole tool 20. The communication from the controller 64 may include data, instructions, or other signals, that may communicate directly with the downhole components. For example, shown mounted on the housing 24 in FIG. 2B is a sensor 68 for monitoring downhole conditions, which may include temperature, pressure, as well as vibration in the downhole tool 20. A communication link is provided to the controller 64 from the sensor 68 via the leads 66. Additional communication between the controller 64 and downhole tool 20 may occur from a probe 70 shown in direct communication with the cylinder 50 for accessing conditions of the fluid 52. In another example, a control line 72 is shown extending from a terminal end of the line 26 and into communication with the energy source 56. The control line 72 may contain or convey instructions to the energy source 56 for varying an amount of electricity delivered to the coil 62 and thereby selectively adjusting viscosity of the fluid 52. The adjustments may be made based upon conditions sensed within the wellbore 22 such as by the sensor 68, probe 70, or other monitoring means. In an example embodiment, sensed conditions in the wellbore 22 may include condition of the wellbore wall 34, presence of the undulations 54, and/or profile of the undulations 54. It is believed that those skilled in the art can ascertain a proper amount of electricity for energizing the fluid 52 to accommodate for the variations in downhole conditions.

Figure 3A:
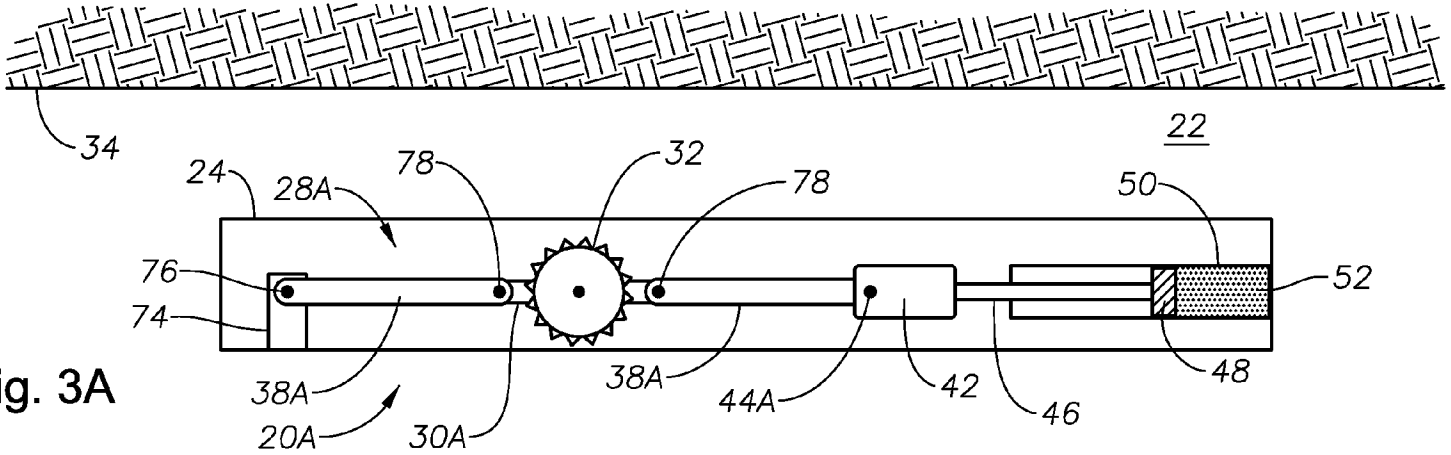
FIG. 3A is a side partial sectional view of an alternative embodiment of a gripper portion of the tractor portion of FIG. 1 in a retracted configuration.

Referring now to FIG. 3A, a side partial sectional view of an alternate embodiment of a downhole tool 20A is shown. In this example embodiment the tool 20A is equipped with a tractor assembly 28A having a roller 32 mounted on the mid portion of an arm 30A. In the embodiment of FIG. 3A, the arm 30A has opposing ends, each coupled to an end of laterally spaced elongate linkage rod 38A, wherein the arm 30A is aligned with and between the linkage rods 38A. In the example of FIG. 3A, the tractor assembly 28A is in a stowed or retracted position and the arm 30A and the linkage rods 38A are shown in a parallel orientation with their elongate sides generally aligned with an elongate length of the downhole tool 20A. Secured within the body 24 is an arm mount 74 shown pivotingly attached to an end of one of the linkage rods 38A and distal from the arm 30A. A pin 76 couples the linkage rod 38A to the arm mount 74 and allows for pivoting motion of the linkage 38A about the arm mount 74. A trolley 42 is shown mounted on the linkage rod 38A distal from the arm mount 74. Pins 78 couple the arm 30A to the linkage rods 38A while allowing pivoting motion between these coupled members. A trolley 42 attaches to the linkage rod 38A via a pin 44A. The trolley 42, similar to the embodiments of FIGS. 2A and 2B, attaches to a piston rod 46 shown with mounted piston 48 set in a cylinder 50, and fluid 52 on a side of the piston 48 opposite the piston rod 46.

Figure 3B:
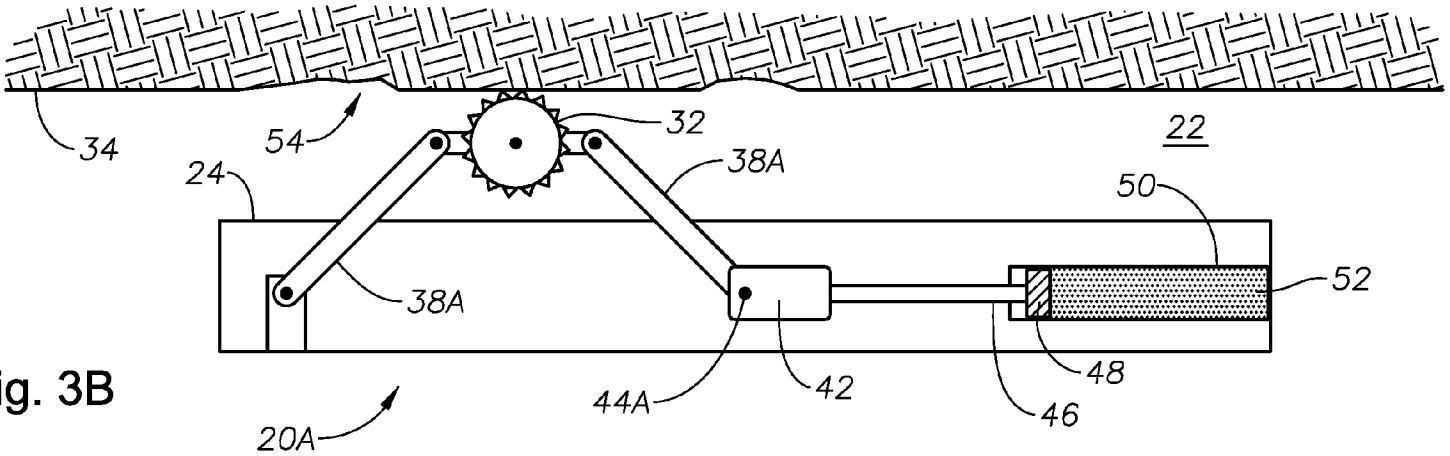
FIG. 3B is a side partial sectional view of an alternative embodiment of a gripper portion of the tractor portion of FIG. 1 in a deployed configuration.

A deployed or extended configuration of the tractor assembly 28A is shown in a side partial sectional view in FIG. 3B. Similar to the deployed configuration of FIG. 2A, in this example the fluid 52 is shown encroached throughout the cylinder 50 to laterally translate piston 48, piston rod 46, and trolley 42; this in turn rotates the linkage rods 38A in opposite directions and outwardly deploys the roller 32 into contact with the wall 34 of the wellbore 22. Although not illustrated in FIG. 3B, a magnetic field source, similar to that provided in FIG. 2B, may be applied to at least a portion of the fluid 52 for dynamic adjustments to the properties of the fluid 52 in response to sensed conditions downhole as described above.

Figure 4A:
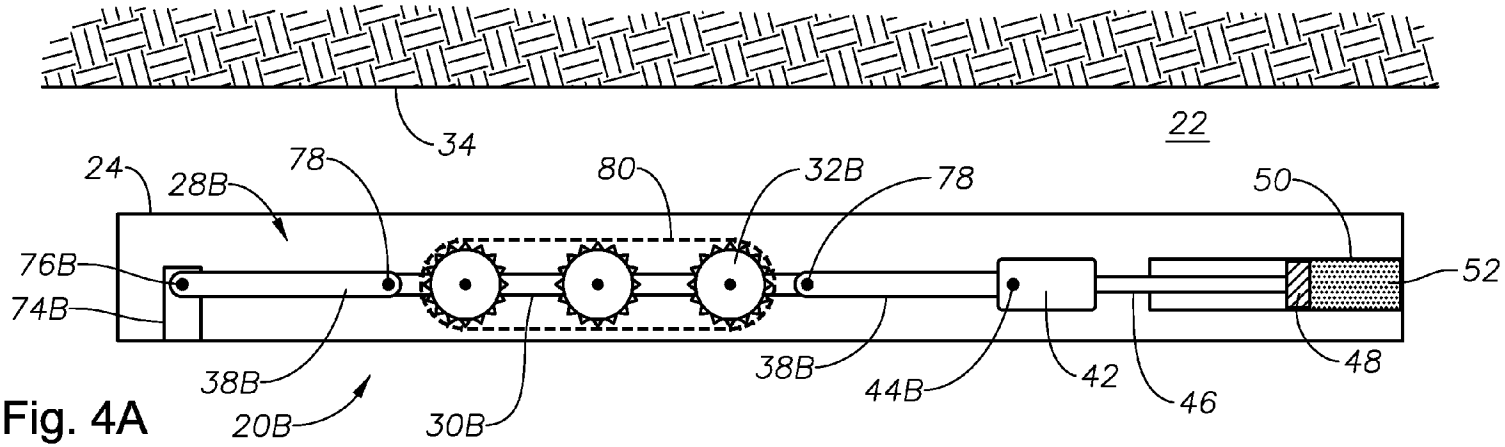
FIG. 4A is a side partial sectional view of an alternative embodiment of a gripper portion of the tractor portion of FIG. 1 in a retracted configuration.

Referring now to FIG. 4A another example embodiment of a tractor assembly 28B is shown in a side partial sectional view. In this example, a series of rollers 32 are shown mounted onto an arm 30B wherein the rollers 30B are coupled to one another by a flexible track 80 shown arranged in a loop fed around the rollers 32B. Similar to the embodiment of FIGS. 3A and 3B, the embodiment of FIG. 4A includes linkage rods 38B on opposite ends of the arm 30B wherein one of the linkage rods 30B pivotingly mounts to an arm mount 74B via a pin 76B. As provided in FIG. 4B, urging the fluid 52 throughout the cylinder 50, such as by a pressure source (not shown) moves the tractor assembly 28B into a deployed position with the track roller 32B to be set against the wellbore wall 34. Again, selective energizing of the fluid 52 can affect damping characteristics of the downhole tool 20B for producing an optimum amount of motivational force through the wellbore 22.

Figure 4B:
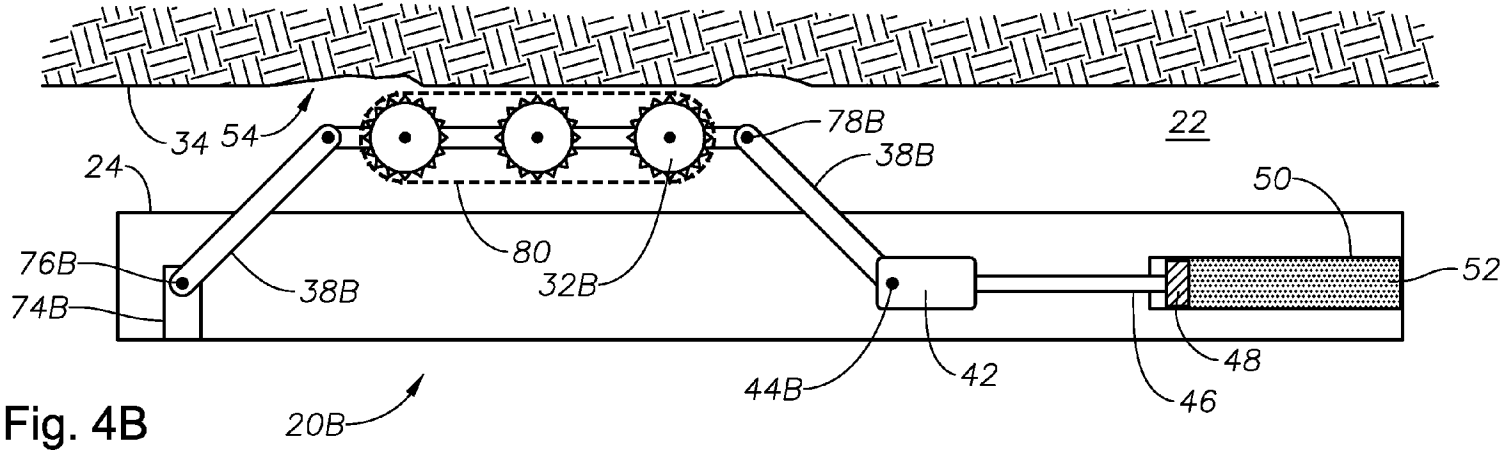
FIG. 4B is a side partial sectional view of an alternative embodiment of a gripper portion of the tractor portion of FIG. 1 in a deployed configuration.
Figure 5A:
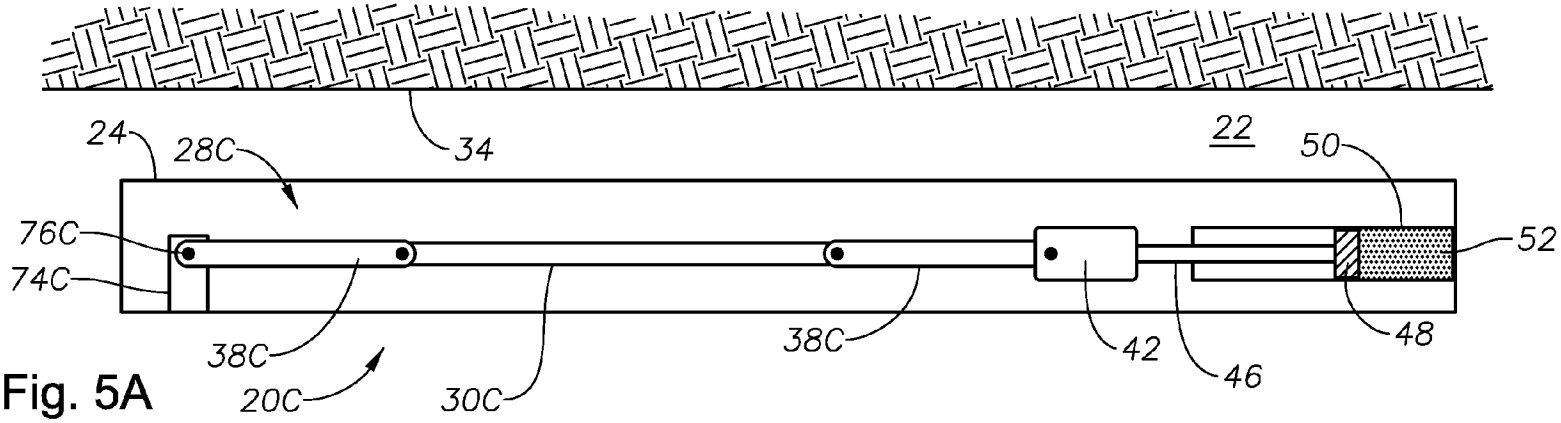
FIG. 5A is a side partial sectional view of an alternative embodiment of a gripper portion of the tractor portion of FIG. 1 in a retracted configuration.
Figure 5B:
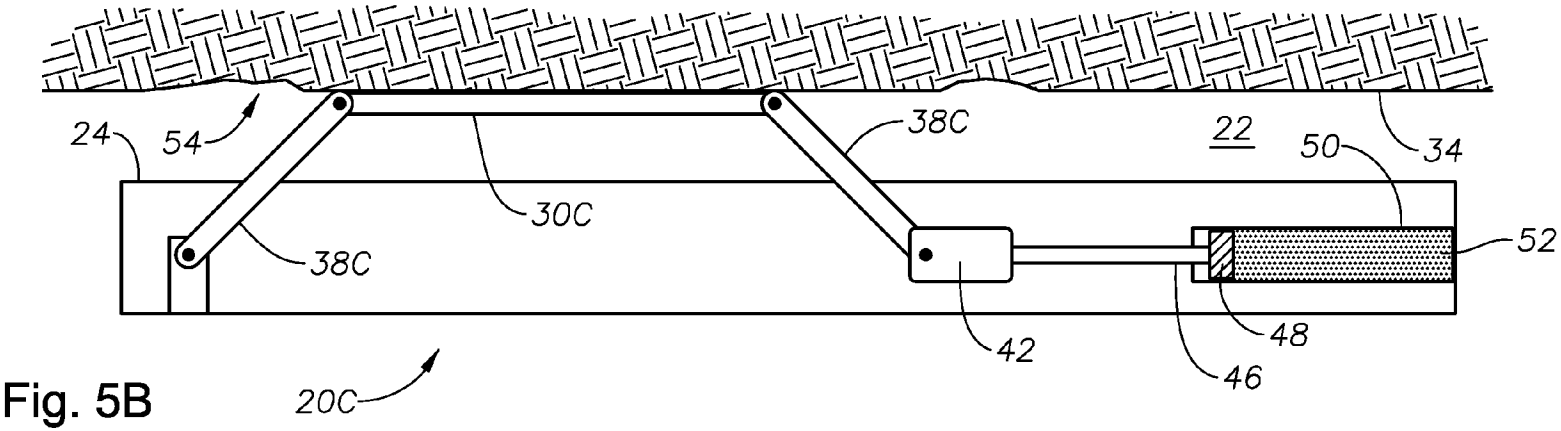
FIG. 5B is a side partial sectional view of an alternative embodiment of a gripper portion of the tractor portion of FIG. 1 in a deployed configuration.

Shown in FIG. 5A is another example embodiment of a tractor assembly 28C having an elongate arm 30C with distal ends pivotingly mounted to linkage rods 38C, which is similar to the arrangement of FIGS. 4A and 4B. In this example however, rollers are not present on the arm 30C, instead, as illustrated in the extended or deployed configuration of FIG. 5B, the arm 30C is deployed out from within the body 24 of the downhole tool 20C and into contact with the wellbore wall 34. Optional grooves or profiles (not shown) may be provided on the surface of the arm 30C for gripping the wellbore wall 34. In this example embodiment, the fluid 52 may be cycled back and forth within the cylinder 50 thereby reciprocating contact of the arm 30C with the wellbore wall 34 and motivating the downhole tool 20C in a desired direction within the wellbore 22.

In an example embodiment, the fluid 52 is a magnetorheological (MR) fluid that is made up of a carrier fluid with magnetic particles suspended within the fluid. In an example embodiment, the size of the particles arranges from about 0.1 microns to about 10 microns. In an example embodiment the magnetic particles are suspended within the carrier fluid at random locations and throughout the fluid. In one example the carrier fluid is oil. By selectively creating or generating a magnetic field within the MR fluid. The particles may align themselves generally in the direction of the flux lines making up the magnetic field. Because this produces a fluid having anisotropic properties, fluid properties can be varied by also varying the direction of the applied magnetic field. As such, embodiments of the method and device employed herein include changing fluid properties by controlling an amount of energy applied to an MF fluid as well as adjusting the orientation of the applied magnetic field.

Figure 6A:
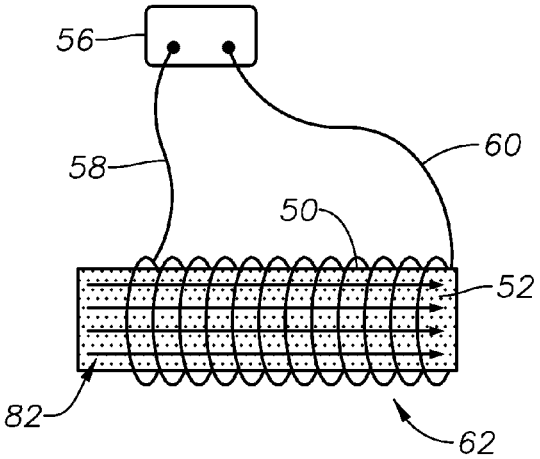
FIG. 6A is a side partial sectional view of an energy source and windings energizing an electrically responsive fluid in accordance with the present invention.
Figure 6B:
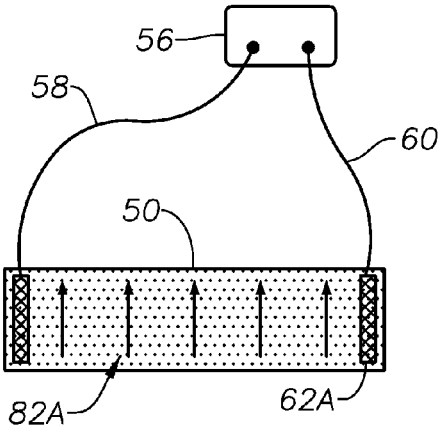
FIG. 6B is a side partial sectional view of an alternate embodiment of an energy source and windings energizing an electrically responsive fluid in accordance with the present invention.

Referring now to FIG. 6A, one example of orienting a coil 62 around a cylinder 50 is shown in a side partial sectional view. In this example, similar to the embodiment of FIG. 2B, the coil 62 circumscribes the cylinder 50. Embodiments exist however, where the coil 62 or windings circumscribe a portion of an accumulator or other vessel (not shown) in which the fluid 52 is retained. In the example embodiment of FIG. 6A, flux lines 82 are shown produced in the fluid 52 and running lengthwise through the cylinder 50. Example power sources for generating the flux lines 82 include a battery or batteries, a permanent magnet, an electro-magnet, and combinations thereof. Optionally, as shown in a side partial section view in FIG. 6B, windings 62A are disposed within a cylinder 50. It should be pointed out, that the cylinder 50 of FIG. 6B can also represent any container or vessel in which the fluid 52 is retained or resides within during operation of the downhole tool. In this sectional view in FIG. 6B, elements within the windings 62 are oriented within the cylinder 50 and in a direction transverse to the winding 62 of FIG. 6A. As such, flux lines 82A are produced when the winding 62A are energized that run transverse to an axis of the elongate cylinder 50. Thus, depending on the desired properties of the fluid 52 more than one winding may be employed, or different types of windings employed, and collectively activated to effectuate a designated fluid property and dependent upon the orientation of the applied magnetic field.

What is claimed is:

1. A tractor assembly for use with a downhole tool, the tractor assembly comprising:

an actuator comprising a cylinder, a piston in the cylinder that is selectively moveable in the cylinder between a deployed position and a stowed position, and a piston rod coupled to a side of the piston;

a gripper coupled to an end of the piston rod distal from the piston, and selectively moveable between a retracted position substantially contained within a body of the downhole tool and an extended position in contact with a wellbore wall;

fluid in the cylinder that is retained in the cylinder on a side of the piston distal from the piston rod and isolated from the piston rod;

magnetically responsive particles in the fluid; and a magnetic field source for selectively generating a magnetic field that intersects the fluid, so that a viscosity of the fluid increases when the magnetic field is applied to the fluid and dampens vibration in the tractor assembly, so that an urging force is selective transferred from the fluid to the piston.

2. The tractor assembly of claim 1, wherein the magnetic field source comprises a winding proximate a portion of the fluid and in communication with a source of electricity for generating the magnetic field that is applied to the fluid.

3. The tractor assembly of claim 2, further comprising a controller in communication with the source of electricity for regulating the amount of vibration damping by the fluid by adjusting a magnitude of the magnetic field.

4. The tractor assembly of claim 3, further comprising a sensor for detecting tractor assembly operating conditions in a wellbore and communicating the operating conditions to the controller.

5. The tractor assembly of claim 4, wherein the tractor assembly operating conditions include a frictional force between the gripper and wellbore wall and wherein the controller adjusts the magnitude of the magnetic field in response to the sensed frictional force.

6. The tractor assembly of claim 2, wherein the windings comprise two windings that are disposed distal from one another and within the cylinder, so that when the windings are energized flux lines are generated in the fluid that project transverse to a length of the cylinder.

7. The tractor assembly of claim 1, wherein the gripper is selected from the group consisting of a roller, a track assembly, and linkage arms.

8. The tractor assembly of claim 1, wherein the fluid comprises carrier oil and the particles range in size from about 0.1 microns to about 10 microns.

9. A downhole tool disposable in a wellbore, the downhole tool comprising:

a body;

a hydraulic actuation system in the body comprising a cylinder, a piston in the cylinder, a piston rod attached to a side of the piston, and a magnetorheological fluid in the cylinder that is retained in the cylinder and isolated to a side of the piston opposite the piston rod, and that is selectively pressurized by a pressure source;

a gripper assembly mounted to the body, coupled to the piston rod, and selectively moveable between a stowed position substantially in the body and a deployed position in contact with a wall of the wellbore in response to movement of the piston and piston rod that occurs under selective pressurization of the fluid by the pressure source; and a selectively activatable magnetic field source, so that when the magnetic field is activated a magnetic field forms in the magnetorheological fluid, thereby altering a viscosity of the magnetorheological fluid and damping vibration in the hydraulic actuation system and the gripper assembly.

10. The downhole tool of claim 9, wherein the gripper assembly comprises a component selected from the group consisting of a roller, a track assembly, and linkage arms.

11. The downhole tool of claim 9, wherein the magnetorheological fluid comprises magnetic particles that range in size from about 0.1 microns to about 10 microns.

12. A method of pulling a downhole assembly through a wellbore, the method comprising:

(a) providing with the downhole assembly an actuator having a piston selectively moveable in a cylinder between a deployed position and a stowed position, a gripper coupled to a piston rod attached to a side of the piston and that is deployed with axial movement of the piston, and magnetorheological fluid retained in the cylinder that is isolated to a side of the piston opposite from the piston rod and does not flow from the cylinder;

(b) deploying the downhole assembly in the wellbore;

(c) pressurizing the magnetorheological fluid to move the piston and piston rod and to deploy the gripper into an extended position in contact with the wellbore wall;

(d) moving at least a portion of the gripper with respect to the wellbore wall so that the downhole assembly is motivated within the wellbore;

(e) sensing operating conditions of the downhole assembly; and (f) selectively energizing the magnetorheological fluid in response to the step of sensing to adjust viscosity of the magnetorheological fluid.

13. The method of claim 12, wherein the operating conditions of step (e) comprise parameters selected from the group consisting compressive strength of the wellbore wall, a profile of the wellbore wall, and a frictional force between the gripper and the wellbore wall.

14. The method of claim 12, wherein the step of adjusting viscosity of the magnetorheological fluid damps vibration in the downhole assembly.

15. The method of claim 12, wherein the step of sensing operating conditions of the downhole assembly comprises monitoring a frictional force between the gripper and the wellbore wall and wherein the step of selectively energizing the magnetorheological fluid adjusts the viscosity of the magnetorheological fluid so the frictional force between the gripper and the wellbore wall is at a value to prevent slippage between the gripper and the wellbore wall.

16. The method of claim 12, wherein the frictional force between the gripper and the wellbore wall is at a minimum value to prevent slippage between the gripper and the wellbore wall.

17. The method of claim 12, wherein a controller is used to determine an amount of electricity for energizing the magnetorheological fluid.

18. The method of claim 12, wherein energizing the magnetorheological fluid comprises flowing electricity through a winding proximate a portion of the magnetorheological fluid.

19. The method of claim 12, further comprising creating flux lines in the fluid that extend generally parallel with an axis of the downhole assembly.

20. The method of claim 12, further comprising creating flux lines in the fluid that extend generally transverse to an axis of the downhole assembly.

* * * * *

UNITED STATES PATENT AND TRADEMARK OFFICE

CERTIFICATE OF CORRECTION

PATENT NO. : 9,097,086 B2
APPLICATION NO. : 13/236101
DATED : August 4, 2015
INVENTOR(S) : AlDossary It is certified that error appears in the above-identified patent and that said Letters Patent is hereby corrected as shown below:

In the claims

Column 8, Line 13, Claim 1, delete “selective” and insert --selectively--.

Signed and Sealed this
Twenty-second Day of December, 2015

Michelle K. Lee

Michelle K. Lee
*Director of the United States Patent and Trademark Office*